United States Patent [19]

Hotkowski et al.

[11] Patent Number: 4,949,952

[45] Date of Patent: Aug. 21, 1990

[54] SHEET JUSTIFIER FOR AUTOMATIC BOOKBINDING MACHINE

[75] Inventors: Peter Hotkowski, Checter; Frank A. Todaro, Clinton, both of Conn.

[73] Assignee: VeloBind, Inc., Fremont, Calif.

[21] Appl. No.: 326,090

[22] Filed: Mar. 20, 1989

[51] Int. Cl.[5] ..... B65H 31/34

[52] U.S. Cl. ..... 271/221; 414/907

[58] Field of Search ..... 414/907; 271/221, 222

[56] References Cited

U.S. PATENT DOCUMENTS

| | | | |
|---|---|---|---|
| Re. 28,202 | 10/1974 | Abildgaard | 412/16 X |
| 3,811,146 | 5/1974 | Abildgaard | 412/43 X |
| 4,270,970 | 6/1981 | Szanto | 412/43 X |
| 4,346,882 | 8/1982 | Pessina | 271/221 |
| 4,369,013 | 1/1983 | Abildgaard | 412/43 X |
| 4,442,743 | 4/1984 | Szanto | 412/43 X |
| 4,645,399 | 10/1987 | Scherer | 416/16 |
| 4,700,941 | 10/1987 | Shill | 271/221 X |

*Primary Examiner*—Richard A. Schacher
*Attorney, Agent, or Firm*—Julian Caplan

[57] ABSTRACT

The apparatus is the justifying station of an automatic bookbinding machine which stages collection of the sheets of the book, justifies the side and end edges of the sheets, feeds male and female plastic bookbinding strips one at a time from cassettes, assembles the sheets and strips and then binds the book. In the sheet justifying apparatus the sheets are deposited on an originally horizontal movable jaw. The latter is then raised toward a stationary jaw until the sheets are loosely clamped. Thereupon the jaws with sheets therebetween are pivotted to vertical position. A first side guide is caused to reciprocate rapidly against one side edge of the stack of shets, justifying the opposite edge against a stationary guide on the opposite side edge. Simultaneously, a front edge of the stack, justifying the rear edge against a stationary base plate.

9 Claims, 3 Drawing Sheets

SHEET JUSTIFIER FOR AUTOMATIC BOOKBINDING MACHINE

CROSS-REFERENCE TO RELATED APPLICATIONS

This invention is an improvement on a portion of pending patent application owned by the Assignee entitled APPARATUS AND METHOD FOR AUTOMATICALLY JUSTIFYING, ASSEMBLING AND BINDING SHEETS IN BOOKS, Ser. No. 116,045, filed Nov. 2, 1987, now U.S. Pat. No. 4,846,616. Reference is also made to pending application entitled CASSETTE FOR BOOKBINDING STRIPS, also owned by the Assignee of this application, Ser. No. 115,999, filed Nov. 2, 1987, now U.S. Pat. No. 4,844,674.

BACKGROUND OF THE INVENTION

1. Field of the Invention

The present invention comprises apparatus for automatically justifying sheets which are punched with holes spaced inward from one margin of the sheet by squaring said one margin and two end margins so that the holes in the sheet are aligned. The book is bound using male and female plastic binding strips which are assembled at the justifying station so that the studs of the male binding strip pass through the aligned holes in the sheets and through holes in the female strip preparatory to binding.

The apparatus of the present invention is a portion of an automatic bookbinding machine. Such a machine has a frame supported above the floor. At the staging station the sheets to be bound are deposited on a tray from which they are fed into the justifying station. Male binding strips are initially packaged in cassettes which are deposited in a male strip hopper and fed one at a time from the cassette and then laterally into the assembly station. Simultaneously, female strips packaged in cassettes are assembled in a female strip hopper whence they are fed one at a time from a cassette and then cross-fed laterally into the assembly station. In the justify station which is the subject of this invention, the sheets are jogged so as to square the edges in common planes and thereby align the holes in the sheets. The assembly station is part of the justifying station, but the details of the assembly portion of the station are fully described in said patent application, Ser. No. 116,045, filed Nov. 2, 1987. After justification, the male strips are pushed inward through the aligned holes in the sheets and through the holes in the female strip. Then the assembled document is fed into the binding station. The binding station may be of several types using, for example, substantial portions of the machine shown in U. S. Pat. No. 3,811,146, whereby the strips are compressed together, thereby compressing the sheets therebetween, the excess stud lengths are cut off and heads are formed on the severed ends of the studs, binding the book together.

2. Description of Related Art

Books of the general type of the end product of the present invention are shown, among other places, in U. S. Reissue Pat. No. 28202. Such books employ male and female binding strips such as are shown in FIGS. 1 and 2 of U. S. Pat. No. 4,369,013.

SUMMARY OF THE INVENTION

As has been stated, the machine of which the present invention is a part has several stations. Only portions of several of these stations are shown and some are not shown at all in the present application, reference being had to the aforesaid application, Ser. No. 116,045, for illustration and description of these other stations. Sheets are prepunched with holes spaced along one edge distances equal to the distances between the studs of the male strips used to bind the book. Such sheets are delivered from a laser printer, copy machine, or other source, into a tray at the staging station.

At other locations in the apparatus, cassettes containing male strips are stacked one on top of the other. The male strips are fed one at a time from the bottom cassette and then one strip at a time is fed transversely into the assembly station in a position adjacent the stack of sheets and with the studs of the male strip aligned with the holes in the sheets. At a corresponding station of the machine the cassettes of female strips are stacked one on the other and the strips are fed out of the bottommost cassette and then transversely one at a time into the assembly station with the female strip on the side of the stack opposite the male strip and with the holes in the female strip aligned with the holes in the stack.

The justifying station comprises a pair of jaws and their mounting structure which are movable from a horizontal position during which the sheets are fed from the staging station, while the strips are being fed from the cassettes. The justify station is then pivotted to a position where the sheets are vertical and the sheets are then jogged so as to justify the same—that is, the side edges of the sheets along which the holes are disposed as well as the end edges of the stack are squared, thereby aligning the holes in all of the sheets. In the interrelated assembly station, as soon as this operation is completed, the male strip is advanced toward the stack so that the studs penetrate the holes in the sheets of the stack and also penetrate the holes in the female strip. Thereupon the stack of sheets and strips are fed transversely into the bind station.

At the bind station, the male strip is compressed against the stack of sheets while the female strip is held stationary, thereby creating a tight bind. Thereupon the binding machine cuts off the excess stud length, preferably by hot knife blades, and then forms rivet heads on the ends of the studs, thereby completing the bind.

The male binding strip may be formed with flexible studs and the female strip with grooves communicating with the holes therein, as shown in U. S. Pat. Nos. 4,685,700 (FIGS. 23-25) and 4,674,900. The binding apparatus for such strips bends the studs down so that they snap into the grooves. It is a principal object of the present invention to justify the edges of the stack of sheets in an improved manner.

One of the advantages of the invention is a considerable increase in the speed with which the sheets are justified, thereby making it possible to bind a book substantially as fast as the pages of the book are printed or copied.

Another feature of the invention is a reduction in labor which is accomplished by use of the apparatus and, further, that the labor required is considerably less skilled than in conventional bookbinding.

The present invention is a logical development of instant book publishing in that it provides a very superior binding for a book in line with a laser or other type printer or copier. The output of the printer or copier is automatically bound.

Other objects of the present invention will become apparent upon reading the following specification and referring to the accompanying drawings in which similar characters of reference represent corresponding parts in each of the several views.

DESCRIPTION OF PREFERRED EMBODIMENT

Supplies Used with the Apparatus

Figure 1:
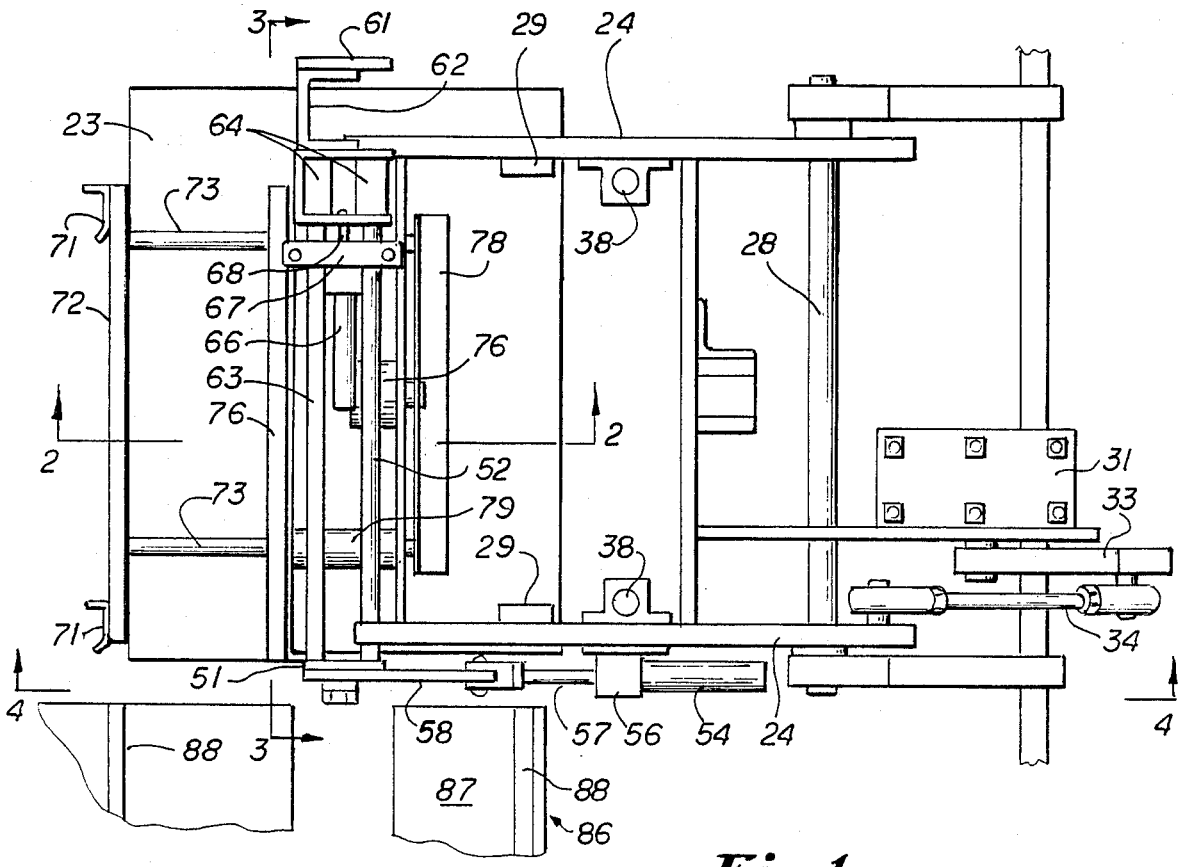
FIG. 1 is a top plan view of the justifying station and a portion of the staging station.
Figure 2:
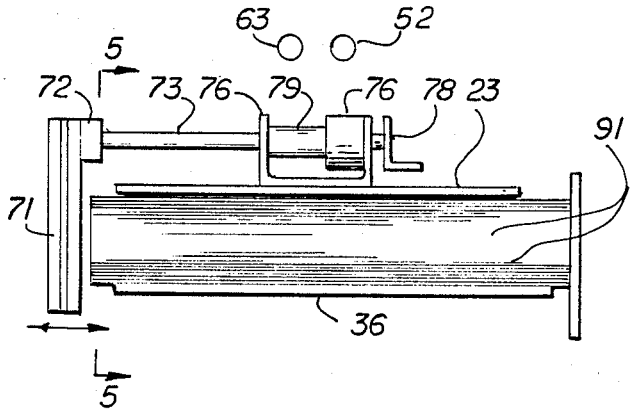
FIG. 2 is a cross-sectional view taken substantially along the line 2—2 of FIG. 1.
Figure 3:
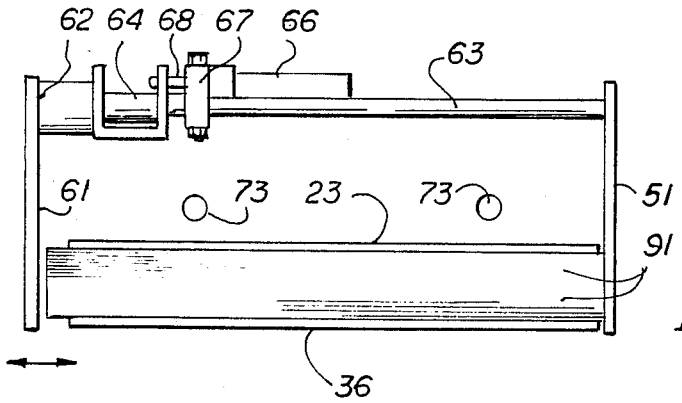
FIG. 3 is a cross-sectional view taken substantially along the line 3—3 of FIG. 1.

Sheets 91 are formed with holes spaced along one edge thereof, spaced inwardly a short distance from said edge. Such sheets are preferably drilled or prepunched and are delivered from a laser printer, copy machine or other source with printed or graphic material thereon.

Male thermoplastic strips 92 are preferably of a type commercially available and are formed with studs 93 spaced along strip 92 distances complementary to the spacing of the holes in the sheets 91. For each strip 92 there is a female strip 98 of the same length formed with holes spaced the same intervals as the holes in the sheets and the studs 93. Initially, the strips 92 and 96 are packaged in separate cassettes (not shown) in which they are transported and stored until the appropriate time in the cycle of operation of the binding machine with which the station is used. The specific details of construction and assembly of the cassettes are set forth in considerable detail in the aforesaid application Ser. No. 115,999.

It will be understood that the justifying apparatus may be used to square the edges of sheets for purposes other than binding with thermoplastic strips and, indeed, for purposes other than binding.

Frame and Controls

The machine of which the justifying station is a portion is preferably supported above floor level by a frame which accommodates the staging, male cassette hopper, female cassette hopper and binding stations, as well as the justifying assembly station with which the present invention is concerned.

As a matter of design choice, a considerable number of pneumatic cylinders are employed and some electric motors are also used. Various sensors are located at various positions in the apparatus to sense proper operation of the mechanical movements. The valves for the pneumatic control lines are located in the control box, as are the switches which control the electrical system. The controls are programmed for proper sequential movement and also to ensure that the machine does not continue to operate unless the various position sensors are properly actuated.

The various wires leading to sensors and motors and the various pneumatic lines leading to cylinders are omitted in the drawings, since their presence on the drawings would be confusing and obscure working elements. How such switches, wires, sensors and tubing would be located will be readily understood by those skilled in the machine design art.

For ease in describing the operation of the various elements of the machine, it will be assumed that as viewed in FIG. 1, the front of the machine is at the left and the rear of the machine is at the right of the figure and that the bottom edge of the figure is the right hand side of the machine and the upper edge of the figure is the left hand side of the machine.

Staging Station

As partially shown in FIG. 1, on the right hand side of the machine is a staging station 86 comprising a tray 87 having sides 88. By means not shown but which will be understood with reference to application Ser. No. 116,045, the sheets are deposited on the tray 87 until a stack of sheets which comprise the book is accumulated. Such sheets have their punched edges along the rear tray side 88.

Justify Station

The justify station 21 is located in the center of the machine. Fixed jaw 23 is attached by brackets 29 to vertical side plates 24 interconnected by cross-ties 27.

Main frame vertical extension 26 is attached by horizontal transverse pivot shaft 28 to the side plates 24. Mounted on the main frame are cylinders 31 which are arranged to oscillate shaft 32. Crank 33 on shaft 32 is pivotally connected to link 34 which is, in turn, pivotally connected to plates 24. Oscillation of shaft 32 causes the justify station 21 to move from the horizontal loading position shown in FIG. 4 to the upright jogging position shown in FIG. 4A and also to a transfer position (not shown) slanted upwardly-rearwardly from pivot shaft 28 in FIG. 4A.

Figure 4:
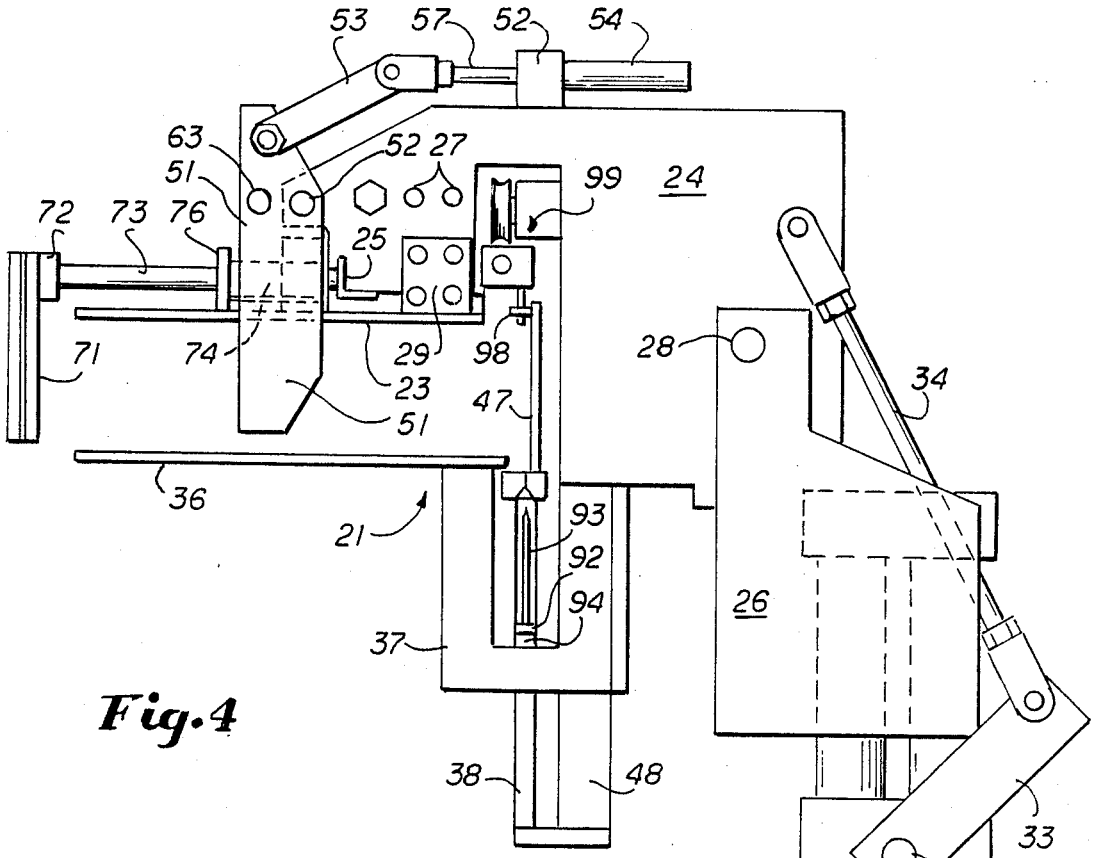
FIG. 4 is a sectional view taken substantially along the line 4—4 of FIG. 1 showing the justifying station in loading position.
Figure 4D:
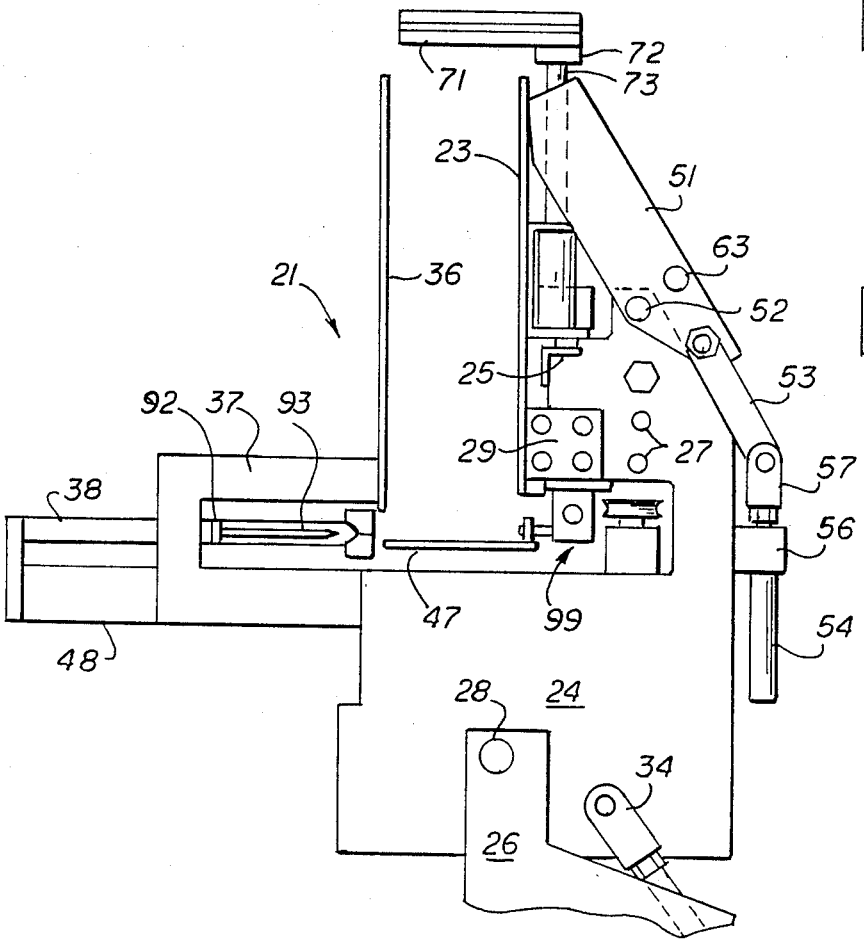
FIG. 4A is a view similar to FIG. 4 showing the station in vertical position.

Parallel to jaw 23 is a movable jaw 36 which is positioned therebelow as viewed in FIG. 4. Subframe 37 (see FIGS. 4 and 4A) is connected to either side of movable jaw 36. Subframe 37 is connected to tie plate 48 which is, in turn, connected to guide shafts 38 received in linear bearings 39 fixed to the inner sides of side plates 24.

Motor 41 (see FIG. 5) turns sprocket pinion 42 which drives a sprocket belt 43, the belt passing around idler sprockets 44. Belt 43 has a clamp 46 fixed thereto which is attached to back plate 47 which is, in turn, connected to movable jaw 36 and subframe 37.

Figure 5:
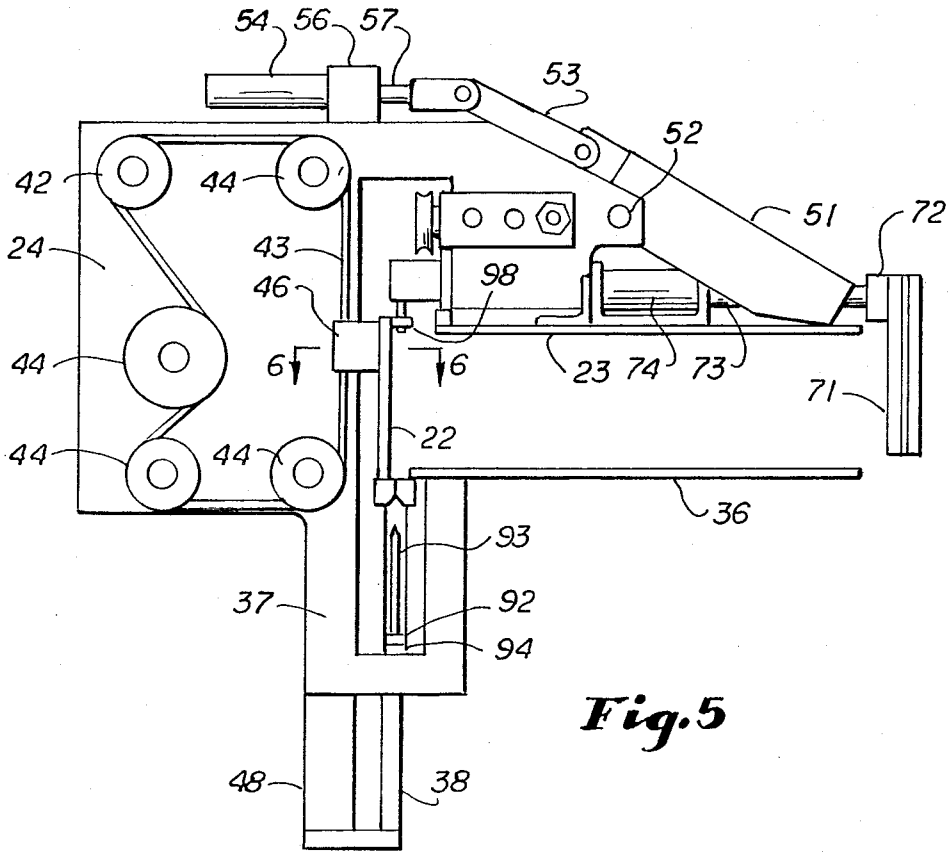
FIG. 5 is a fragmentary sectional view taken substantially along the line 5—5 of FIG. 2.
Figure 6:
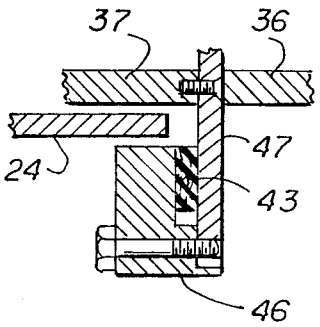
FIG. 6 is a fragmentary sectional view taken substantially along the line 6—6 of FIG. 5.

Accordingly, as motor 41 drives belt 43 along a vertical path, as shown in FIG. 5, back plate 47 and movable jaw 36 are advanced toward and away from fixed jaw 23. It will be understood that the number of sheets in a book may vary. Hence, after the stack of sheets is transferred from staging station 86 onto movable jaw 36, jaw 36 is raised until the top of the stack of sheets approaches fixed jaw 23, whereupon a sensor (not shown) causes the motor 41 to be de-energized.

On the right hand side of jaws 23 and 36 is a right side guide 51 which oscillates in a longitudinal vertical plane. Guide 51 is attached by pivot 52 to side plate 24 and is connected by link 53 to the rod 57 of cylinder 54 mounted on side plate 24 by support 56. Actuation of cylinder 54 causes the right side guide 51 to move from the down position, shown in FIG. 4, to the retracted position shown in FIG. 4A. It will be understood that when sheets are loaded from the staging tray 87 into the justify station 21, the right guide 51 is retracted to permit the sheets to move. However, after the sheets are loaded onto the jaw 36, the guide 51 is moved to down position, as shown in FIG. 4, and serves as a backstop for the sheets being jogged by the left side guide 61.

Left side guide 61 is attached by bracket 62 to horizontal transverse shafts 63 and 52 connected to right side guide 51. Bearings 64 attached to bracket 62 receives the rod 68 of cylinder 66 which is attached to clamp 67 to the upper side of fixed jaw 23. Thus, as cylinder 66 is energized, left side guide 61 is forcibly moved to the right and then retracted to the left, the rightward movement causing the sheets 91 to be jogged against the right side guide 51 and thereby justified.

On the front of the machine to either side are vertical front guides 71 which are interconnected by front cross-tie 72. Rods 73 received in bearings 79 mounted on jaw 23 are attached to cross-tie 72 and rear cross-tie 78 and are actuated by cylinder 76, connected to rear cross-tie 78. The energization of cylinder 76 causes the front guides 71 to reciprocate rapidly, jogging the sheets 91 against the back plate 47 and justifying same.

Operation

When a stack of sheets has been accumulated in the staging station 86 resting on the tray 87 between the sides 88, the justify station 21 is in down position, as shown in FIG. 4, with the movable jaw 36 in its fully retracted (down) position and right side guide 51 in its retracted position. By means not shown, the sheets on tray 87 are moved horizontally onto the jaw 36. Thereupon, guides 51 and 61 are moved to down position by cylinder 54. At the same time, motor 41 is energized, raising movable jaw 36 toward jaw 23 until there is about a one-quarter inch space between the top of the stack of sheets on the jaw 36 and jaw 23.

Thereupon, cylinders 31 are energized causing the justify station to be raised from the horizontal position of FIG. 4 to the vertical position of FIG. 4A. Cylinders 76 and 66 are then rapidly energized, causing the guide 61 to jog the sheets against the stationary guide 51 and simultaneously the front guide 71 to jog the sheets downwardly against the base plate 47. Upon completion of the jogging movements, all of the holes in sheets 91 are aligned. Male strip 92 is moved from the male hopper station inwardly along support 94 until the studs 93 are aligned with the holes in the sheets 91. Simultaneously, the female strip 98 is advanced along its support 99 until the holes in strip 98 are likewise aligned. Thereupon, by means not illustrated but shown in the accompanying application Serial No. 116,045, the strip 92 is raised causing the studs 93 guided by guide 96 to pass through the holes in the sheets 91 and thence through the holes in the strip 98.

Thereupon, the assembled book is transported by means not shown into the binding station.

WHAT IS CLAIMED IS:

1. For use in a bookbinding machine to bind books using a stack of sheets each formed with first holes spaced apart and spaced from adjacent a spine edge of said sheets, a male strip having studs projecting therefrom at the same intervals as said first holes and a female strip having second holes spaced at the same intervals as said first holes, a justifying apparatus comprising, a justifying assembly frame, a base plate a first jaw projecting at right angles to said base plate, a second jaw spaced below, parallel to and aligned with said first jaw, tilting means for tilting said frame between a first position with said jaws substantially horizontal and a second position with said jaws substantially vertical, a first side guide mounted on a first side of one of said jaws, a second side guide mounted on a second side of said one jaw opposite said first side guide, pivot means on one said jaw for pivoting at least said first side guide from a first position between said jaws to a second position remote from the space between said jaws, reciprocating means for rapidly reciprocating one of said side guides toward and away from the other said side guide for jogging sheets on said second jaw against said other guide.

2. Justifying apparatus according to claim 1 which further comprises edge guide means mounted on an edge of one of said jaws opposite said base plate and extending across the space between said jaws, second reciprocating means for rapidly reciprocating said edge guide means toward and away from said base plate for jogging sheets on said second jaw against said base plate.

3. Justifying apparatus according to claim 1 which further comprises means for moving one of said jaws toward and away from the other said jaw.

4. Justifying means according to claim 3 in which said last named means comprises a side on said frame extending perpendicular to said jaws, a reversible motor mounted on said side, a belt, drive means driven by said motor and engaging said belt and idler means guiding said belt for movement parallel to said side, a link fixed to said belt, connecting means connecting said link to said one jaw whereby said motor moves said one jaw parallel to said side toward and away from said other jaw.

5. Justifying means according to claim 4 in which said one jaw is fixed for movement with said base plate, said base plate being spaced from said jaws whereby said motor also moves said base plate.

6. Justifying apparatus according to claim 1 in which said pivot means comprises a pivot shaft mounted on said one jaw transverse to side guides, said one side guide being mounted on said pivot shaft, a cylinder fixed to said frame, said cylinder having a rod, linkage connecting said rod to said one side guide whereby hereby actuation of said cylinder causes said one side guide to pivot about said pivot shaft.

7. Justifying apparatus according to claim 6 which further comprises a second shaft interconnecting said first and second side guides, the other said guide also being mounted on said pivot shaft, whereby actuation of said cylinder causes the other said side guide to pivot about said pivot shaft.

8. Justifying means according to claim 7 in which said other side guide is movable parallel to said pivot shaft and said second shaft toward and away from said one side guide and which further comprises a second cylinder fixed to said one jaw parallel to said pivot shaft, said second cylinder having a second rod connected to said other side guide, whereby actuation of said second cylinder causes said other side guide to reciprocate.

9. Justifying means according to claim 2 in which said edge guide means comprises at least two guides on opposite sides of and extending perpendicular to said one jaw and in which said second reciprocating means comprises a rod fixed to each said edge guide disposed parallel to said one jaw and on the side of said one jaw opposite said other jaw, a cross tie interconnecting said rods for movement together, bearings on said one jaw slidably receiving said rods, an abutment on said one jaw and at least one cylinder interposed between said abutment and said cross tie, said cylinder when actuated causing said edge guides to reciprocate relative to said one jaw.

* * * * *